US005450695A

United States Patent [19]

Desai

[11] Patent Number: 5,450,695

[45] Date of Patent: Sep. 19, 1995

[54] TELESCOPING DERRICK

[75] Inventor: Vinod Desai, Houston, Tex.

[73] Assignee: Dreco, Inc., Houston, Tex.

[21] Appl. No.: 151,511

[22] Filed: Nov. 12, 1993

[51] Int. Cl.[6] ..... E04H 12/18

[52] U.S. Cl. ..... 52/118; 52/123.1; 52/745.17; 52/745.18

[58] Field of Search ..... 52/118, 123.1, 745.17, 52/745.18

[56] References Cited

U.S. PATENT DOCUMENTS

| | | | |
|---|---|---|---|
| 1,299,261 | 4/1919 | Taylor | 52/745.18 |
| 1,644,499 | 10/1927 | Trout | 52/123.1 |
| 3,185,265 | 5/1965 | White | 52/123.1 |
| 4,885,893 | 12/1989 | Wasterval, Jr. et al. | 52/123.1 |
| 5,216,867 | 6/1993 | Wasterval, Jr. et al. | 52/745.17 |

*Primary Examiner*—Carl D. Friedman
*Assistant Examiner*—Christopher Todd Kent
*Attorney, Agent, or Firm*—Lalos & Keegan

[57] ABSTRACT

A telescoping four-sided drilling derrick and method of erection that is to be positioned on a drill floor over a well bore and is capable of withstanding severely adverse weather, environmental or geologic conditions. The derrick is in several sections and includes a bottom section, a top section and at least one intermediate section all for superpositioning over the bottom section to form a vertical four-sided tower. Each of the sections is composed of vertical members positioned in each of the four corners of each section to thereby form a total of four faces around the perimeter of each section. A window is one face sufficiently large to receive consecutively therebelow at least one section. In turn each of the intermediate sections is inserted within the bottom section for subsequent serial telescopic raising of the intermediate sections. Thereafter support means is connected across the window after the last intermediate section has been received within the bottom section so as to substantially close the window and rigidify the bottom section to enable the bottom section and the derrick to withstand the stress imposed by the superposed sections and any severely adverse conditions.

10 Claims, 5 Drawing Sheets

TELESCOPING DERRICK

BACKGROUND OF THE INVENTION

The present invention relates to a drilling derrick and a method for erecting a drilling derrick on a fixed platform, a jackup platform or on a floating barge. More particularly the present invention relates to both the drilling derrick and method of erection that produces a derrick of significant strength and a capability of withstanding serious adverse weather, environmental or geologic conditions.

Drilling derricks are well known in the art and are very substantial structures that rise to a vertical height of at least about 150 feet up to a maximum of near 190 feet. Unlike the masts that are used for crane operation in oil field operations, drilling derricks are necessarily four-sided structures that must withstand the rigors of heavy winds and seas that include hurricanes and typhoons or earthquakes or other earth tremors that would topple far less sturdy structures. The drilling derrick must be erected on site because of its great weight and cannot be erected in a safe or quiet location and transported to the site. It has in the past been attempted to have masts constructed in sections and have the sections superposed one upon the other at the drill site but such proposals are not successful because with the height required for the drilling derrick, a crane must lift very heavy sections 100 to 150 feet above the drilling level or platform to effect the erection. Normally these platform cranes are small to medium size having significant reach and weight limitations and they are not tall enough to erect a derrick in one piece.

If a crane on a floating barge is to be used to attain the proper height, there is a great expense involved because the offshore platforms are often located from a few miles to several hundred miles offshore making the use of a very large barge crane impractical and extremely expensive.

The prospect of installing on the drilling platform a crane having the size and reach to be able to lift the drilling derrick even in sections is uneconomical for any platform owner to install such a huge crane capable of such erection of a drilling derrick in single or multiple lifts. This problem is particularly acute because drilling contractors typically drill a group of wells from a single platform and then move on to drill a group of wells on a different nearby platform so that every time the drilling rig—comprising: a drilling derrick; supporting structure; drilling machinery, etc.; used to drill a well bore for each well—must be moved from platform to platform. Thus the rig must be rigged up for a new location and then broken down to move by transport barge and a platform crane to a new location. The frequency of the rig up and transportation has made desirable some type of drilling derrick capable of being moved and yet capable of withstanding the serious adverse conditions of weather, environmental or geologic occurrences.

The current approach used by many drilling contractors is to erect the drilling derrick in a piece-by-piece method that enables the platform owner to achieve the desired drilling derrick structure of a rigid and serviceable drilling derrick. The problem, however, with this approach is it is labor intensive and usually takes from several days to at least several weeks to construct such a derrick in an piece-by-piece or stick-by-stick method.

Another problem is posed by safety regulations promulgated by the British and Norwegian governments that do not permit the stick-by-stick building of a drilling derrick requiring at times the rental of a huge semi-crane at a cost of several hundred thousand dollars per day. Even that possibility for erection of a drilling derrick is limited due to extreme weather conditions in many areas such as the North Sea where it is reasonably expected that an erection of a derrick could only be accomplished within a period of six to eight months a year. For these and other reasons experienced by those skilled in the art the problem of erecting a drilling derrick sufficient to meet the severe adverse conditions and to do so in an economical and safe manner has been a problem facing the oil and gas industry.

SUMMARY OF THE INVENTION

A telescoping four-sided drilling derrick that is to be positioned on a drill floor over a well bore and is capable of withstanding severely adverse weather, environmental or geologic conditions. The derrick is in several sections and includes a bottom section, a top section and at least one intermediate section all for superpositioning over the bottom section to form a vertical four-sided tower. Each of the sections is composed of vertical members positioned in each of the four corners of each section to thereby form a total of four faces around the perimeter of each section. Each of the faces in each section includes at least one bracing cross member supporting adjacent vertical members and at least one bracing cross member in the bottom section being secured along an upper and minor portion of the base of said bottom section so as to form a window. The window is to be sufficiently large to receive consecutively therebelow at least one section. In turn each of the intermediate sections are inserted within the bottom section for subsequent serial telescopic raising of the intermediate sections. Thereafter support means is connected across the window after the last intermediate section has been received within the bottom section so as to substantially close the window and rigidify the bottom section to enable the bottom section and the derrick to withstand the stress imposed by the superposed sections and any severely adverse conditions.

The method of erecting a four-sided drilling derrick for positioning on the drill floor over a well bore and being capable of withstanding severely adverse weather, environmental or geologic conditions including steps of forming a four-sided tower composed of a bottom section, top section, at least one intermediate section superposed as a portion of the drilling derrick. Constructing each of the sections with vertical members positioned in each of the four corners of the sections forming a face between adjacent members. Then bracing mutually adjacent members with at least one cross member connected thereto and connecting at least one bracing cross member along an upper and minor portion of the face of said bottom section thereby forming a window without bracing members below the bracing cross member. The window is to be sufficiently large so as to receive in series each of the intermediate sections therewithin. Thereafter, inserting at least one intermediate section through the window into the bottom section and then telescoping each intermediate section vertically upwardly serially upon the inserting and thereafter closing the window by connecting support members across the window to rigidify the bottom section to enable said bottom section in the derrick to withstand the stress imposed by the superposed section in any adverse conditions.

DESCRIPTION OF THE PREFERRED EMBODIMENT

Figure 1:
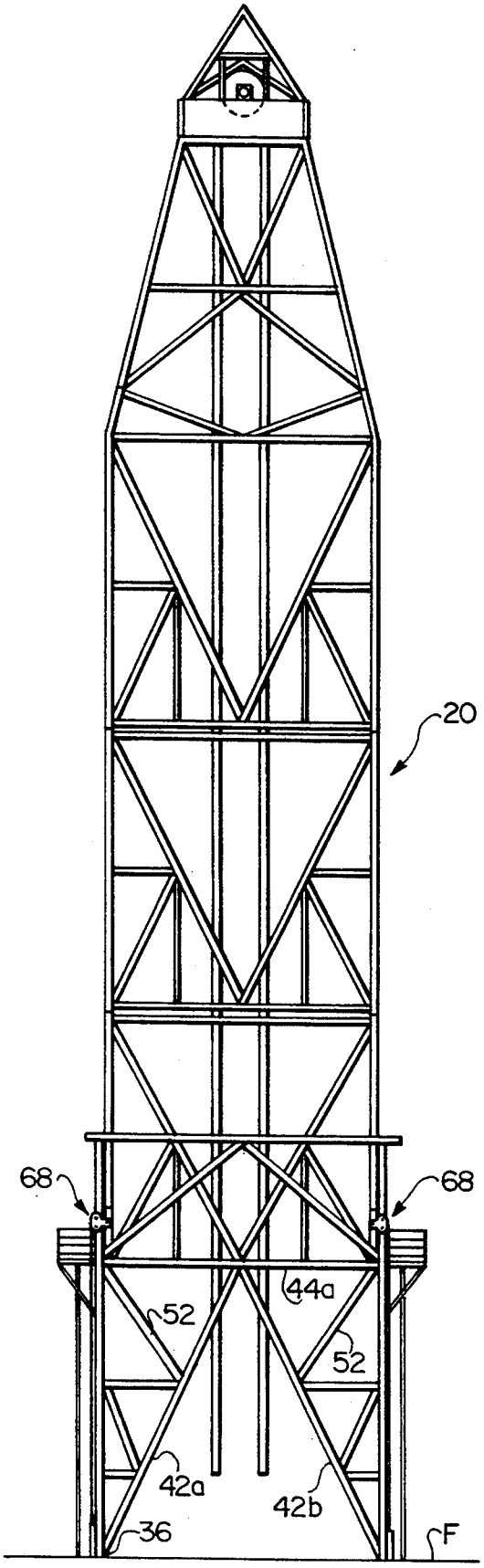
FIG. 1 is a side view of the drilling derrick of the present invention.
Figure 2:
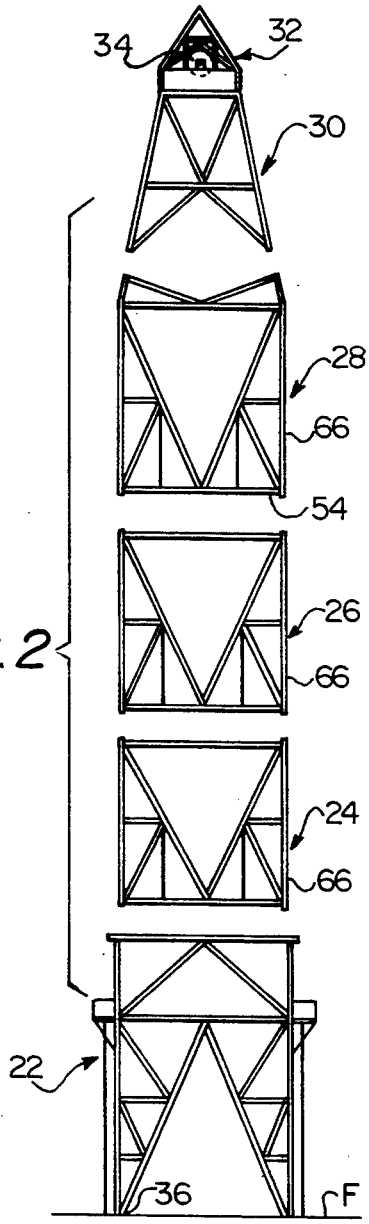
FIG. 2 is an exploded view of the bottom section, a lower section, a lower intermediate section, an upper intermediate section, a top section and a crown frame and crown block section at the very top of the drilling derrick.

The completed derrick directed in accordance with the present invention is shown in FIG. 1 generally at 20. In FIG. 2, an exploded view, the individual sections of the derrick 20 are clearly illustrated. The principal sections are bottom section 22, lower section 24, lower intermediate section 26, upper intermediate section 28, top section 30 and crown section 32 shown attached to the top of top section 30 along with crown block 34 positioned within the crown section 32. The derrick 20 is positioned on drill floor F by conventional means that securely fastens the bottom 36 of bottom section 22 to the drill floor F. As is conventional, the drilling derrick 20 is positioned over the drill hole, not shown, but always positioned along the center line axis of the derrick 20.

Figure 3:
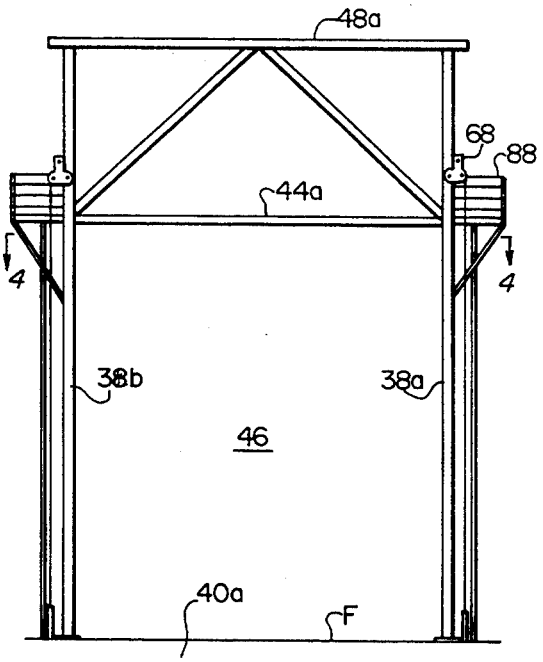
FIG. 3 is a side view of the bottom section prior to insertion of any of the upper intermediate sections therein.
Figure 5:
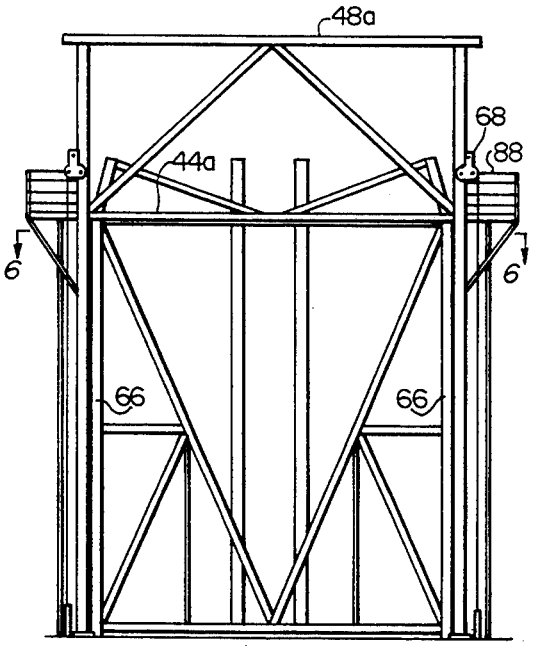
FIG. 5 is a view of the top section inserted down through the top of the bottom section to a position on the drilling floor.
Figure 3A:
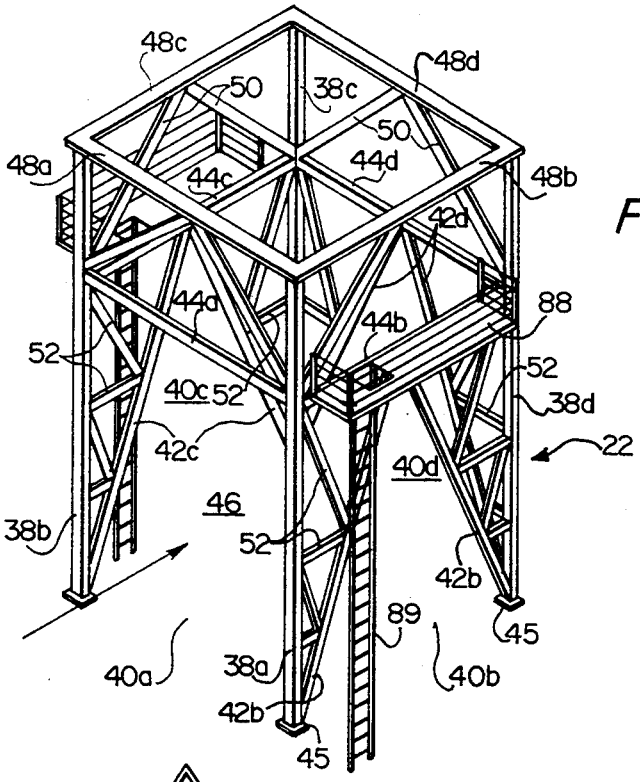
FIG. 3A is a perspective view of the bottom section as shown in FIG. 3 illustrating the window on one side of the bottom section.

The perspective view of the bottom section, as illustrated in FIG. 3A, depicts the structure of the bottom section more clearly and attention is directed thereto. As can be readily seen, the bottom section is composed of four vertical members each being positioned in the corner of the cross section of the bottom section illustrated at 38*a* through 38*d*. Each pair of vertical members forms a face respectively 40*a*, 40*b*, 40*c* and 40*d*. Each face is therefore bordered on two sides by a pair of vertical members 38*a* through 38*d*. For instance, face 40*a* is formed across the space between vertical members 38*a* and 38*b*. Likewise face 40*b* is formed between vertical members 38*a* and 38*d*. Similarly face 40*c* is formed between vertical members 38*b* and 38*c* and face 40*d* is formed between vertical members 38*c* and 38*d*.

As more clearly depicted in FIG. 3A, each of three faces, 40*b*, 40*c* and 40*d* is obstructed by supporting cross members 42*b*, 42*c* and 42*d*. For example, supporting cross members 42*b*, 42*b* extend across face 40*b*. These cross members are angled to be secured to the bottom 36 of the bottom section at 45 for each of the angled cross members 42*b*, 42*b* and at their respective upper ends are secured to a cross member 44*b* that may be horizontal as shown that braces the vertical members. Similarly, in each of faces 40*c* and 40*d* corresponding bracing cross members 42*c*, 42*c* and 42*d*, 42*d* that may be angled as shown are positioned and secured to their respective horizontal bracing cross member 44*b*, 44*c* or 44*d*.

Face 40*a* alone is not initially provided with any of the angled cross members such as 42*b* through 42*d* and the space bordered on the top by bracing cross member 44*a* and vertical members 38*a* and 38*b* constitutes a window 46 that is completely unobstructed and allows totally free access to the interior of the bottom section 22.

Extending above the window 46 and in particular above horizontal cross member 40*a* is an upper horizontal cross member 48*a* that along with similar upper horizontal cross members 48*b*, 48*c* and 48*d* are attached to the upper extremities of vertical members 38*a*, 38*b*, 38*c* and 38*d* for the purpose of forming a more rigid bottom section. Upper angled cross members 50 numbering two are secured in each area between the lower horizontal cross members 44*a* through *d* and upper horizontal cross members 48*a* through *d*. Additional support members 52 not constituting a meaningful part of the invention are provided between adjacent angled cross members 42*b* through *d* and corresponding adjacent vertical members 38*a* through *d*.

As is quite apparent from FIGS. 3 and 4 the interior within the bottom section 22 is completely open below the upper horizontal cross members 48 and capable of receiving axially therethrough an upper section for telescopic raising. It is also to be noted that the bottom section 22 as best shown again in FIGS. 3A and 4A but also in FIG. 3 is provided with a window 46 that is unobstructed and free of any structural encumbrances or support members.

In FIGS. 1 and 2, there are shown the additional sections that are used to erect the derrick of the present invention. The structural elements and the construction of lower section 24, lower intermediate section 26, upper intermediate section 28 and top section 30 are all similar to that described in detail with respect to bottom section 22. However the cross members 42, 44 and structural members 52 are slightly changed. It should be understood, however, that the sections 24 through 32 do not constitute an aspect of the present invention and are essentially conventional.

Figure 4:
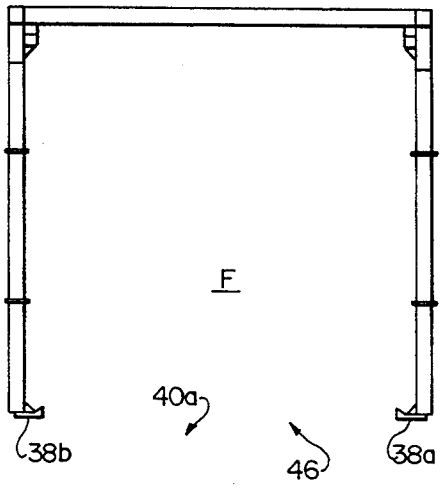
FIG. 4 is a cross-sectional view along lines 4—4 of FIG. 3 illustrating the presence of the window on one side of the bottom section.
Figure 6:
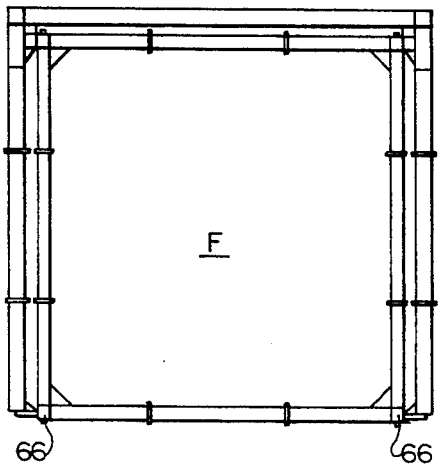
FIG. 6 is a cross-sectional view along lines 6—6 of FIG. 5.

The window 46 is a prominent aspect of the present invention and can be readily viewed in FIGS. 3, 3A and 4. This window is designed to be of such height from the drill floor F to the bottom of the lower horizontal cross member 44*a* in order to receive therein lower intermediate section 26 and thereafter lower section 24 for consecutive telescopic movement upwardly.

Figure 7:
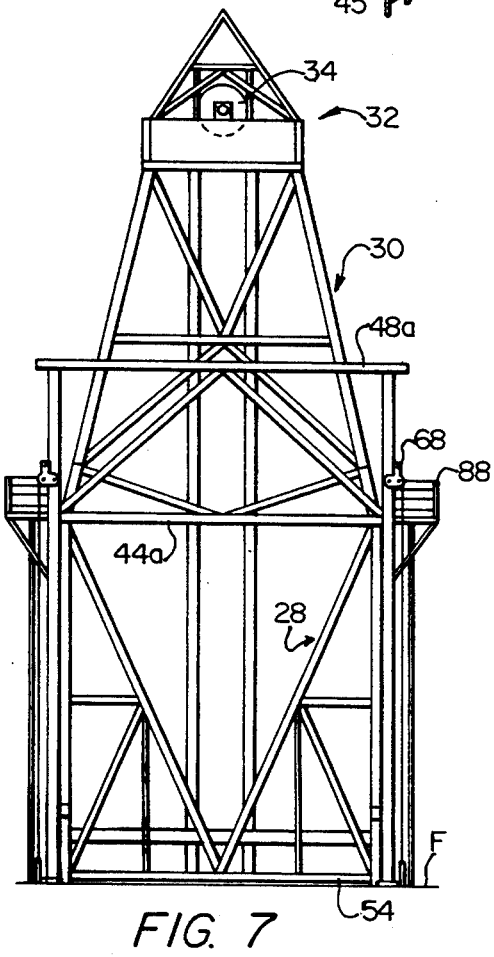
FIG. 7 is a side view of the bottom section with inserted top section and the superposed crown frame and block.

In the erection of the derrick of the present invention, upper intermediate section 28 is first raised by a crane, not shown, and deposited axially downwardly within the bottom section 28 so that the bottom 54 of upper intermediate section 28 rests on the drill floor F, as best shown in FIG. 7. In that position the top section 30 with crown section 34 and crown block 34 may be axially superposed in a conventional manner on top of upper intermediate section 28 again as shown clearly in FIG. 7. Thereafter as shown in FIG. 8 both the upper intermediate section 28 and top section 30 with the additional crown section 32 and crown block 34 are elevated telescopically and retained in place as seen in FIG. 8 by means and methods that will be hereafter described in detail.

Figure 8:
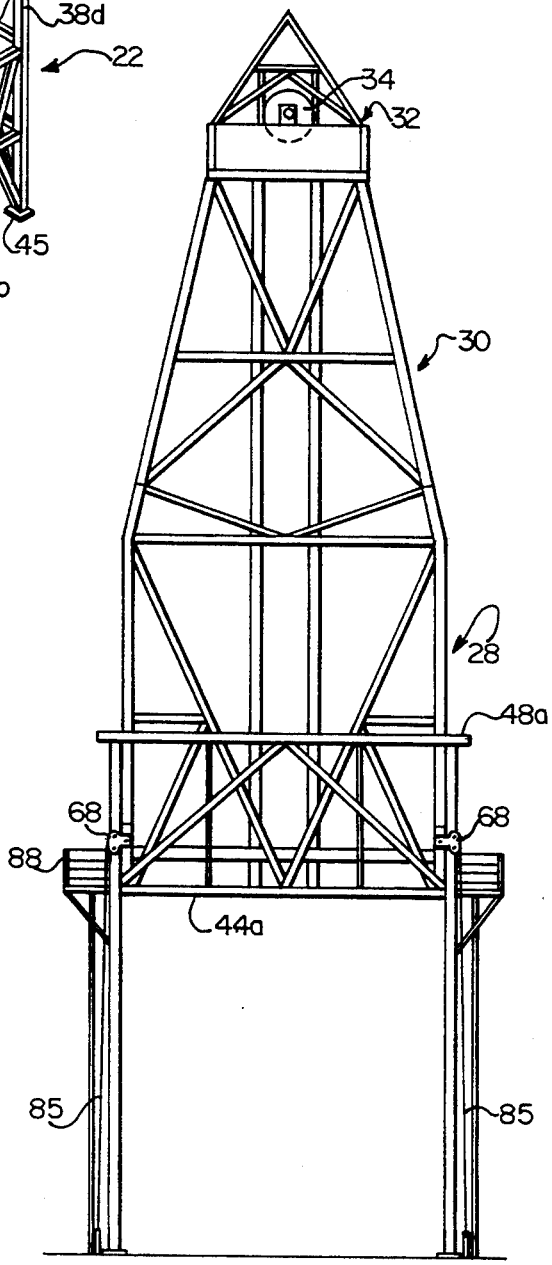
FIG. 8 is a side view of the drilling derrick subsequent to the telescoping of the upper intermediate section, top section and crown frame and crown block.

The method of the present invention is quite apparent from the FIG. 8 position of the partially erected derrick. It can be seen that the lower intermediate section 26 may then be positioned below the upper intermediate section 28 by passing the lower intermediate section 26 through the window 46 and into alignment with the upper intermediate section 28. The lower intermediate section then is telescopically raised along with the previously installed upper intermediate section and top section to make room below the lower intermediate section 26 for the next section, for the lower section 24, to be inserted through the window 46 in the manner precisely the same as the lower intermediate section 26 had been inserted through the window 46. In such position then the lower section may be telescopically raised which is in turn raising lower intermediate section 26, upper intermediate section 28 and top section 30.

Figure 9:
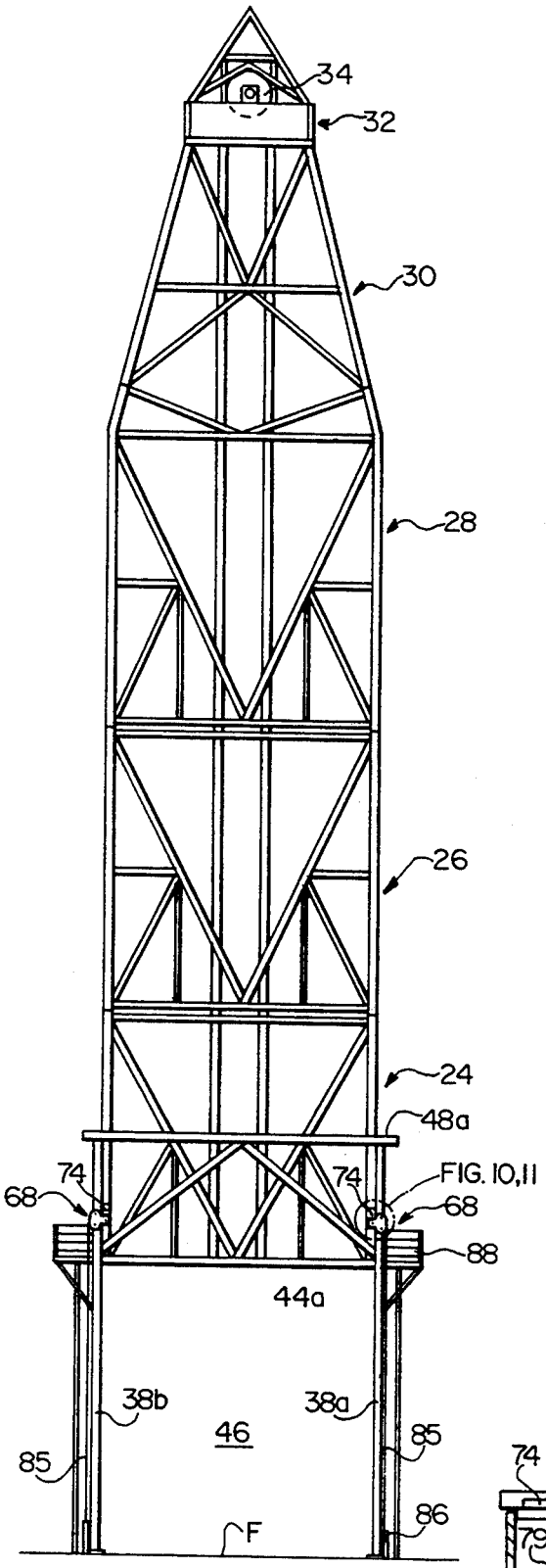
FIG. 9 is a side view of the joint derrick assembly after additional intermediate sections have been telescoped upwardly.

After each of those sections has been raised, the erection of the derrick will take the appearance as shown in FIG. 9 wherein the derrick 20 has been erected to its final height and all sections have been telescopically raised into proper position. Each of the sections is connected one to the other in a conventional manner.

Figure 13:
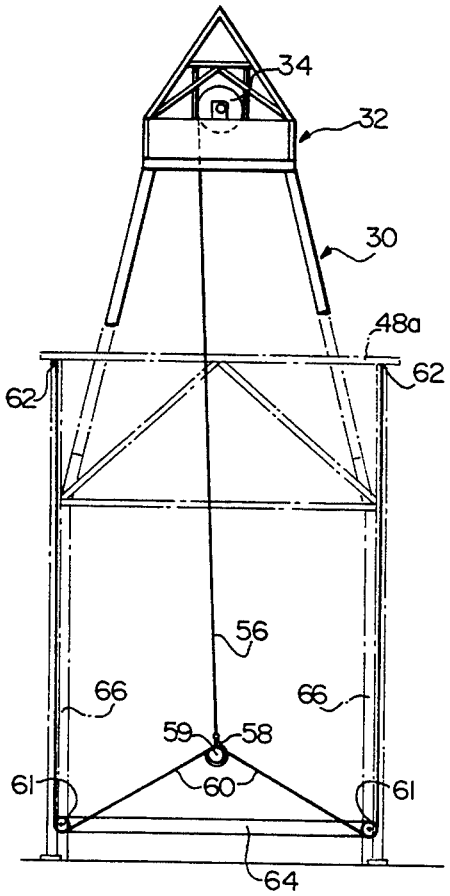
FIG. 13 is a side view illustrating the telescoping frame used for raising the telescoping sections.
Figure 14:
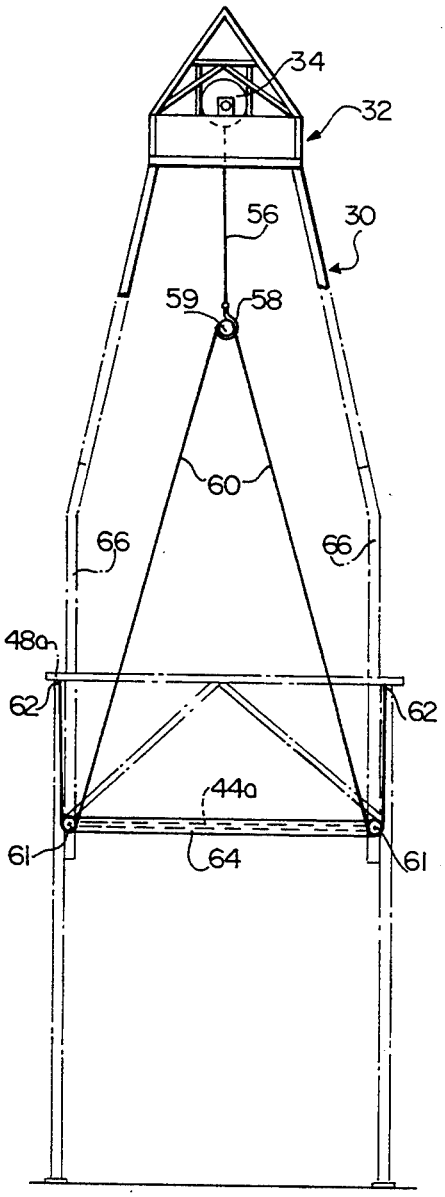
FIG. 14 illustrates the completed telescopic movement of the sections using the telescoping frame.

The means used for telescopically raising the sections is shown in FIGS. 13 and 14. The telescopic mechanism includes line 56 depending from and reeved through crown block 34 and operated through draw works, not shown. At the end of line 56 is a hook 58. The hook 58 engages a bar 59 around which the scoping line 60 is reeved. Scoping line 60 is continuous on both sides of the bar 59 as shown in FIGS. 13 and 14 and is reeved around sheaves 61 and attached to the opposed upper horizontal cross members 48*b* and 48*c* at 62. The sheaves 61 are positioned at the ends of the scoping frame 64.

Scoping frame 64 is shown as a bar but may be in the form of a frame coextensive with of the section to be telescopically raised and is attached for instance in any convenient and conventional manner to the inside of the vertical members 66 on the upper intermediate section. For each of the succeeding sections to be telescopically raised, the frame would be similarly attached to the inside of the corresponding vertical members also shown as 66.

When the scoping bar of frame 64 is securely attached as by bolts to the respective section at or near its bottom, the line 56 is drawn upwardly by the draw works and as such the hook 58 pulls up the equalizing bar 59 to continually allow each segment of line 60 to be equal in length as the segments extend down to their respective sheaves 61, 61. When the scoping frame 64 is raised up from the position shown in FIG. 13 to that shown in FIG. 14, it is desired to hold the telescopically raised section to be held in position so that the next lower section may be inserted through the window 46 and attached to the bottom of the previously telescopically raised section.

Figure 10:
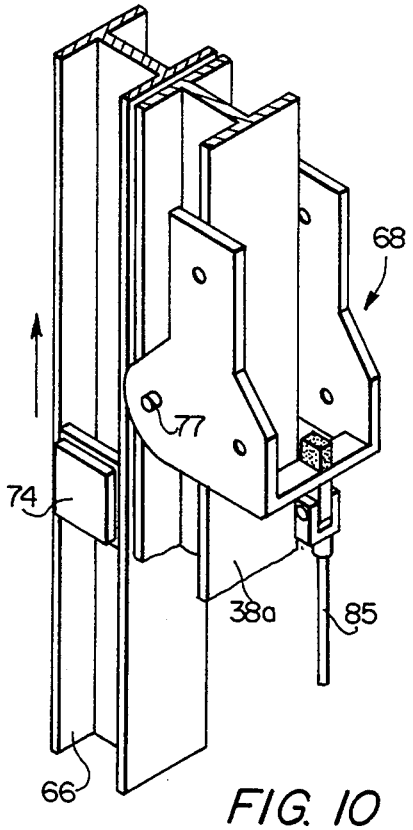
FIG. 10 is a perspective view partly broken away of the latch assembly shown substantially enlarged from that of FIG. 9.
Figure 11:
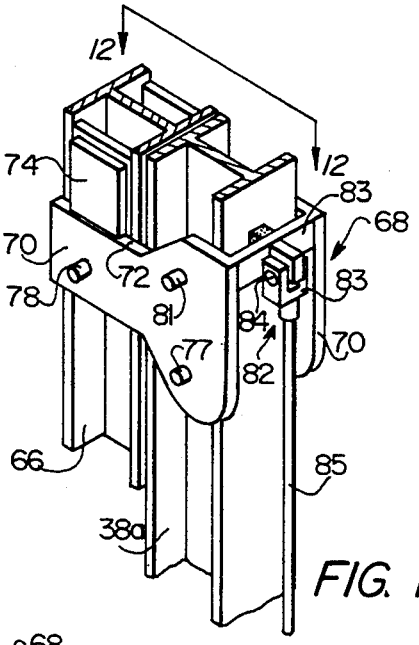
FIG. 11 is a perspective view partly broken away of the latch assembly in a supporting mode enlarged from the showing at FIG. 9.
Figure 12:
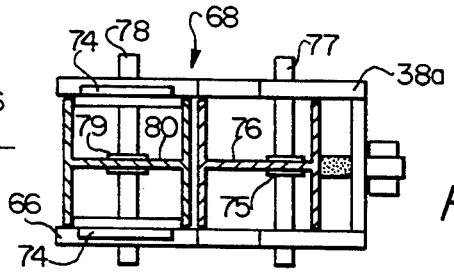
FIG. 12 is a cross-sectional view taken along line 12—12 of FIG. 11.

FIGS. 9, 10, 11 and 12 are directed to the latch shown generally at 68 for holding the previously telescopically raised sections. Latch 68 is composed of a pair of opposed pivoting arm plates 70, 70 that are positioned on vertical members 38*a* and 38*b*. Each plate 70 is provided with an abutment surface 72 for contact with abutment 74 suitably secured to the opposite sides of vertical members 66 as best shown in FIG. 12. Arm plates 70 are pinned together through appropriate opening 75 in web 76 of vertical member 38*a* and 38*b* by means of bolt 77. Similarly, bolt 78 is designed to pass through opening 79 in web 80 of vertical member 66 to secure the latch in place as it abuts the abutment 74. In a similar fashion bolt 81 is added for further security and acts in a manner similar to bolt 78 but on vertical member 38*a*. Pivot mechanism 82 pivots the latch 68 about pin 77 as an axis. Bar 83 is secured between the inside surfaces of the respective arm plate 70, 70 and is offset from pivot axis of bolt 77 so that movement of yoke 83 pivotally secured at 84 to cross bar 85 will pivot the latch 68 about axis 77 as the yoke is moved upwardly or downwardly. Yoke 83 is operated by control rod 85 so as to move the latch 68 into and out of positions shown in FIGS. 10 and 11.

As can be readily seen from FIGS. 9 through 12 as the sections are telescopically raised by the scoping frame 64, the abutment 74 rises above the level of latch 68 sufficiently high to allow latch 68 to pivot downwardly from its inoperative position shown in FIG. 10 to move the latch from its inoperative position in FIG. 10 to its operative position in FIG. 11. Control rod is raised upwardly pivoting latch 68 about the axis 77 so as to allow abutment surface 72 to engage abutment 74 upon the section and therefore vertical member 66 being lowered into abutment contact as shown in FIGS. 11 and 12. In such position the previously telescopically raised section is fully and completely supported by the latch after suitable pins 78 and 81 have been inserted for security and safety reasons.

As best seen in FIGS. 1, 7, 8 and 9 the control rod 85 extends down along each vertical member 38*a* and 38*b* to the drill floor F where a suitable control handle 86 is present. Of course, it is to be understood that the control rod may be operated electrically or hydraulically by any suitable means that are well known to those skilled in the art and is not limited to the mechanical arrangement that has been discussed above. It should be evident that having the control operation for the latch 68 operable from the drill floor, it is not necessary for working personnel to be up on the derrick to the extent that had been previously required when more secure connective means was required. Now the assembly of several pins makes the mutual securing of the sections simple and easy after being telescopically moved upwardly.

A service platform 88 and suitable access ladder best shown in FIG. 3A, is added for convenience of the workers to provide whatever maintenance is necessary and of course to install the bolts as may be necessary.

Once the upper intermediate section is telescopically moved upwardly from the position shown in FIG. 7 to that shown in FIG. 8 and the latch is engaged as shown at FIG. 8, the scoping frame 64 is lowered and installed at the bottom end of the next section to be scoped upwardly, the lower intermediate section 26. When the lower intermediate section 26 is assembled and set on the drill floor F in front of the window 46 of the bottom section 22 the lower intermediate section 26 may be pulled inside the window 46 by winches and wirelines not shown so that the lower intermediate section 26 is aligned with the previous scoped telescopically raised upper intermediate section 28. At that time the control rod is operated to disengage the latches from the abutment 74 upon the raising of the upper intermediate section 28 using the scoping frame 64 to the point that the abutment rises above the reach of the arm plate 70 of the latch and then the upper intermediate section is lowered onto the top of the lower intermediate section 26 where they are bolted together in conventional fashion. The scoping frame 64 has been lowered and installed at the bottom end of the lower intermediate section 26 for a repeat of the previous telescoping movement.

After the successive sections, the lower intermediate section 26 and the lower section 24 and any other section that may be desired to be telescopically raised to heighten the derrick the assembly will take on the appearance as set forth in FIG. 9. In this state, the window 46 that had permitted the access of the intermediate sections for raising to heighten the derrick becomes a liability because of the inherent weakness and lack of rigidity created by the unsupported space constituting the window 46. It is one important aspect of the present invention that the window be secured and braced using support members 42*a* and 42*b* that are angled from the bottom of the bottom section 36 up to essentially the mid-point of the horizontal cross member 44*a* as best shown in FIG. 1. Suitable additional structural members 52 may be added as shown to close the window 46 and provide the structural rigidity necessary for a derrick of superior height and allow it to withstand the adverse conditions that are to be anticipated for this drilling derrick.

It must be understood that the number, type or location of the support members 42*a* and 42*b* is not critical provided that the window 46 that was previously open to admit derrick sections is now closed to provide added rigidity to the derrick.

When disassembling the drilling derrick the procedure must be reversed and the window 46 must be opened by removing the support cross members 42*a* and 42*b* along with the structural members 52 and the scoping frame attached to the bottom of the section to be lowered the latch 68 opened and the entire derrick above the bottom section lowered to the drill floor where the process, the reverse of the erection process is continued.

From the foregoing it is believed that the intentions and purposes of the invention have been met and that the invention should be limited solely by the appended claims wherein

I claim:

1. A telescoping four sided drilling derrick for positioning on a drill floor over a well bore and being capable of withstanding severely adverse weather, environmental or geologic conditions comprising:

a bottom section, a top section and at least one intermediate section for super positioning over said bottom section to form a vertical four sided drilling derrick, each of said sections being composed of vertical members positioned in each of the four corners of said section, four faces being formed around the perimeter of each said section between adjacent said vertical members, said vertical members of said intermediate section having an abutment secured to a vertical side of said vertical member, a latch means positioned on the upper end of said bottom section and having an abutment surface thereon for operating contact with the abutment of said vertical member, each of said faces in each section including at least one bracing cross member supporting adjacent said vertical members, said at least one bracing cross member in said bottom section being secured along an upper portion of the base of said bottom section forming a window, said window being sufficiently large to receive consecutively below said at least one bracing cross member each of said intermediate sections within said bottom section for subsequent serial telescopic raising of said intermediate sections, support means connected across said window to substantially close said window and rigidify said bottom section to enable said bottom section and said derrick to withstand the stress imposed by the superposed sections and any said adverse conditions.

2. The derrick of claim 1 including, control means for selectively operating said latch means connected to said latch means.

3. The derrick of claim 2 including, said control means extending to said drill floor.

4. The derrick of claim 1 including, a telescoping frame positioned below an intermediate section for supporting and telescopic raising of said intermediate section, means for raising said telescopic frame to telescopically raise said intermediate section, latch means positioned proximal to the upper end of said bottom section to support the bottom of said intermediate section, said latch means being secured to said bottom section by a pivot means, said latch means including an abutment arm for abutting the bottom of said intermediate section to support said intermediate section, control means for selectively operating said latch means connected to said latch means, said control means extending to said drill floor, a bracing cross member extending between and connected to said adjacent vertical members and forming at least one side of said window, and said bracing cross member forming the top of said window.

5. The derrick of claim 1 including, said abutment being positioned on each side of said vertical member and between the ends thereof, said latch means being formed from a pair of opposed arm plates, each of said plates having thereon said abutment surface.

6. The derrick of claim 1 including, control means for selectively operating said latch means positioned at the drill floor.

7. The derrick of claim 1 including, said abutment being positioned on each side of said vertical member and between the ends thereof, said latch means being formed from a pair of opposed arm plates, each of said plates having thereon said abutment surface, and control means for selectively operating said latch means positioned at the drill floor.

8. The derrick of claim 1 including, control means for selectively moving said latch means either to an inoperable position out of contact with said vertical member or to said operative contact with the abutment of said vertical member, said control means positioned at the drill floor for remotely operating said latch means to said inoperable position.

9. The derrick of claim 1 including, said abutment being positioned on each side of said vertical member and between the ends thereof, said latch means being formed from a pair of opposed arm plates, each of said plates having thereon said abutment surface, control means for selectively operating said latch means positioned at the drill floor, control means for selectively moving said latch means either to an inoperable position out of contact with said vertical member or to said operative contact with the abutment of said vertical member, and said control means positioned at the drill floor for remotely operating said latch means to said inoperable position.

10. The method of erecting a four sided drilling derrick for positioning on a drill floor over a well bore and being capable of withstanding severely adverse weather, environmental or geologic conditions comprising:

forming a four sided structure composed of a bottom section, a top section and at least one intermediate section superposed as a portion of said drilling derrick, constructing each of said sections with vertical members positioned in each of the four corners of said section forming a face between adjacent members, bracing mutually adjacent members with at least one cross member connected thereto, connecting at least one bracing cross member along an upper portion of the face of said bottom section thereby forming a window without bracing members below the bracing cross member, said window being sufficiently large to receive in series each of said intermediate sections therewithin, providing a latch having an abutment surface on said vertical members of said bottom section, providing an abutment on the vertical side of said vertical members of said intermediate section, inserting at least one intermediate section through said window into said bottom section, moving said abutment surface to an inoperable position to permit the raising of said intermediate section, initiating and controlling the movement of said abutment surface at the drill floor, telescoping each intermediate section vertically upwardly serially upon said inserting, moving said abutment surface to an operable position to abut said abutment on the vertical side of said vertical members of said intermediate section to support said intermediate section, initiating and controlling moving said abutment surface at the drill floor, closing said window by connecting support members across said window to rigidify said bottom section to enable said bottom section and said derrick to withstand the stress imposed by the superposed section and any adverse conditions.

* * * * *